US012570332B2

(12) United States Patent
Weidenfelder et al.

(10) Patent No.: US 12,570,332 B2
(45) Date of Patent: Mar. 10, 2026

(54) CHASSIS FOR A RAIL VEHICLE

(71) Applicant: Siemens Mobility Austria GmbH, Vienna (AT)

(72) Inventors: Thomas Weidenfelder, Eisbach (AT); Gerd Löffler, Empersdorf (AT); Christian Moser, Graz (AT); Roland Paar, Seiersberg (AT)

(73) Assignee: Siemens Mobility Austria GmbH, Vienna (AT)

( * ) Notice: Subject to any disclaimer, the term of this patent is extended or adjusted under 35 U.S.C. 154(b) by 924 days.

(21) Appl. No.: 17/764,597

(22) PCT Filed: Sep. 29, 2020

(86) PCT No.: PCT/EP2020/077232
§ 371 (c)(1),
(2) Date: Mar. 29, 2022

(87) PCT Pub. No.: WO2021/063947
PCT Pub. Date: Apr. 8, 2021

(65) Prior Publication Data

US 2022/0355831 A1 Nov. 10, 2022

(30) Foreign Application Priority Data

Sep. 30, 2019 (AT) ..... A50827/2019

(51) Int. Cl.
*B61C 9/50* (2006.01)
*B61F 3/04* (2006.01)
*B61F 5/52* (2006.01)

(52) U.S. Cl.
CPC ..... *B61C 9/50* (2013.01); *B61F 3/04* (2013.01); *B61F 5/52* (2013.01)

(58) Field of Classification Search
CPC ..... B61C 9/50; B61F 3/04; B61F 5/52
See application file for complete search history.

(56) References Cited

U.S. PATENT DOCUMENTS 2,089,263 A * 8/1937 Huntman ..... B60G 21/055 267/191
2,195,331 A * 3/1940 Huntman ..... B60G 21/055 267/191

(Continued)

FOREIGN PATENT DOCUMENTS

CN 105292139 2/2016
CN 105292139 A * 2/2016

(Continued)

OTHER PUBLICATIONS

PCT International Search Report dated Jan. 20, 2021 based on PCT/EP2020/077232 filed Sep. 29, 2020.

*Primary Examiner* — Jason C Smith
(74) *Attorney, Agent, or Firm* — Cozen O'Connor

(57) ABSTRACT

A chassis for a rail vehicle includes at least one chassis frame to which at least one first wheel set and a second wheel set are coupled and to which at least one first drive unit and a second drive unit are connected, wherein a first coupling rod is connected at least to the first drive unit in an articulated manner and is configured to be coupleable to the vehicle body of the rail vehicle in an elastic manner, such that advantageous structural conditions are achieved.

16 Claims, 2 Drawing Sheets

(56) References Cited

U.S. PATENT DOCUMENTS

| | | | | | |
|---|---|---|---|---|---|
| 5,335,602 | A * | 8/1994 | Richter | B61F 5/44 | 105/182.1 |
| 5,524,550 | A * | 6/1996 | Richter | B61F 5/44 | 105/167 |
| 9,694,831 | B2 * | 7/2017 | Kreuzweger | B61F 5/08 | |
| 11,673,607 | B2 * | 6/2023 | Viereck | B62D 21/11 | 280/124.1 |
| 2022/0169291 | A1 * | 6/2022 | Rosenkranz | B61F 5/22 | |
| 2022/0355831 | A1 * | 11/2022 | Weidenfelder | B61F 5/50 | |
| 2023/0202536 | A1 * | 6/2023 | Prix | H01Q 1/32 | 105/182.1 |

FOREIGN PATENT DOCUMENTS

| | | | | | |
|---|---|---|---|---|---|
| DE | 3718254 | C2 * | 8/1991 | | |
| EP | 0420801 | | 4/1991 | | |
| EP | 0420801 | A1 * | 4/1991 | | |
| EP | 0501204 | | 9/1992 | | |
| EP | 0501204 | A1 * | 9/1992 | | |
| EP | 0918007 | | 5/1999 | | |
| EP | 2089263 | | 8/2009 | | |
| EP | 3272614 | | 1/2018 | | |
| RU | 2134644 | C1 | 8/1999 | | |
| RU | 133486 | U1 | 10/2013 | | |
| RU | 2573100 | C1 | 1/2016 | | |
| RU | 2585131 | C1 | 5/2016 | | |
| WO | 2011141510 | | 11/2011 | | |
| WO | 2015117678 | | 8/2015 | | |
| WO | WO 2021/063947 | | 4/2021 | | |
| WO | WO-2021244971 | A1 * | 12/2021 | | B61C 9/50 |

* cited by examiner

CHASSIS FOR A RAIL VEHICLE

CROSS-REFERENCE TO RELATED APPLICATIONS

This is a U.S. national stage of application No. PCT/EP2020/077232 filed 29 Sep. 2020. Priority is claimed on Austrian Application No. A50827/2019 filed 30 Sep. 2019, the content of which is incorporated herein by reference in its entirety.

BACKGROUND OF THE INVENTION

1. Field of the Invention

The invention relates to a chassis of a rail vehicle, with at least one chassis frame, to which at least a first wheelset and a second wheelset are coupled and to which at least a first drive unit and a second drive unit are connected.

2. Description of the Related Art

Draw rods or draw/buffer rods as longitudinal followers can barely be connected to end carriages of chassis frames of chassis of rail vehicles, because firstly lengths of the draw rods or the draw/buffer rods are too short and, as a consequence, angles as a result of swivel and tilting operations of the chassis would become too great. Secondly, clearances for guiding the draw rods or the draw/buffer rods below a drive unit to crossmembers of the chassis frame are available only to a small extent on account of a limited installation space budget. Furthermore, a suitable arrangement of the draw rods or draw/buffer rods to reduce weight transfers between chassis and wagon bodies during starting or braking operations of the rail vehicle frequently causes difficulties.

Longitudinal followers via swivel pins are known from the prior art, for example.

Longitudinal followers of this type have the disadvantage that they have a solid configuration and that a pronounced weight transfer is caused on account of relatively high force introduction points between the wagon body and chassis. In order for it to be possible for even high starting pulling forces of a rail vehicle to be transmitted, in the case of pronounced weight transfers on rails, different loading states have to be compensated for at wheelsets of the chassis in an electric manner, for example, via a drive regulation, or via actuators. In the case of an electric compensation of weight transfers, motors, power converters, cables, wheelset shafts, etc. have to be correspondingly oversized.

WO 2015/117678 A1 discloses a rail vehicle with a longitudinal follower of a wagon body by way of a chassis via a swivel pin.

WO 2011/141510 A1 describes a drive of a rail vehicle. The drive is connected cardanically firstly to a chassis or a wagon body of the rail vehicle and secondly to a wheelset of the chassis. On account of its cardanic mounting, the drive can be moved rotationally with regard to two rotational axes that are oriented perpendicularly with respect to one another and are in turn oriented perpendicularly with respect to a rotor rotational axis of the drive.

EP 3 272 614 A1 additionally discloses a chassis for a rail vehicle, the wheelsets of which have a smooth steering behavior that is achieved based on ball-joint connections of a drive of the rail vehicle to a chassis frame.

In particular, the two last-mentioned approaches have the disadvantage in the known forms of a movability of the drives relative to the chassis frames, wheelsets and/or wagon bodies of the rail vehicles, where the movability is excessive for certain categories of rail vehicles and/or chassis and/or for certain traveling speed ranges.

SUMMARY OF THE INVENTION

It is an object of the invention to provide a chassis that is developed further in comparison with the prior art, where the chassis in accordance with the invention have a longitudinal follower and drive mounting in manner of that make acceleration and retardation with low weight transfers possible.

This and other objects and advantages are achieved in accordance with the invention, by a chassis in which a first coupling rod is connected in an articulated manner to the at least first drive unit and is configured such that it can be coupled in a sprung manner to a wagon body of the rail vehicle.

As a result, a mechanically decoupled longitudinal force transmission is achieved, in the case of which firstly moderate forces are introduced into the chassis and into the wagon body, and secondly swivel movements and compression and rebound movements of the chassis below the wagon body are not impeded, and largely jolt-free starting and braking are ensured. Spring stiffnesses of a spring or a plurality of springs of the first coupling rod can be dimensioned such that they are adapted to required pulling force ranges and required straighten and swivel resistances of the chassis.

Heavy and expensive components for the transmission of force with a high space requirement that cause pronounced weight transfers in the case of starting and braking operations of the rail vehicle, such as a yoke that is mounted centrally on the chassis, can be dispensed with.

It is advantageous if the at least first drive unit is connected to the at least first wheelset via a coupling, such that it can be displaced in the direction of the chassis transverse axis, is connected via a first bearing apparatus to a first crossmember of the at least one chassis frame in a sprung manner and such that it can be moved in the direction of the chassis transverse axis, and is connected via a second bearing apparatus to a second crossmember of the at least one chassis frame in a sprung manner and such that it can be moved in the direction of the chassis transverse axis, where the at least first drive unit is mounted such that it can be moved rotationally about a drive vertical axis which can be displaced in the direction of the chassis transverse axis.

This measure achieves drive mounting that is adapted to the longitudinal follower via the first coupling rod. Movements which disrupt the longitudinal follower (i.e., rotational or tilting movements about a chassis longitudinal axis and about the chassis transverse axis) of the first drive unit are avoided. Merely small rotational movements about the drive vertical axis are possible, where the drive vertical axis can also move with the first drive unit in the direction of the chassis transverse axis on account of a translational movability of the first drive unit in the direction of the chassis transverse axis.

Despite a restricted rotational movability, transversely elastic mounting of the first drive unit is made possible, where the first drive unit acts as an absorber in relation to vibrations transversely with respect to a traveling direction of the rail vehicle.

One favorable embodiment is obtained if first stiffnesses of the first bearing apparatus and the second bearing apparatus in a plane that is formed by a chassis longitudinal axis and a chassis vertical axis and second stiffnesses of the first bearing apparatus and the second bearing apparatus in the direction of the chassis transverse axis can be set independently of one another. As a result, it is possible to provide a stiff characteristic in the direction of the chassis longitudinal axis and the vehicle vertical axis and a soft characteristic of the drive mounting in the direction of the chassis transverse axis.

One advantageous solution, in the case of which a first stiffness of the first bearing apparatus and the second bearing apparatus in a plane which is formed by a chassis longitudinal axis and a chassis vertical axis is greater than a second stiffness of the first bearing apparatus and the second bearing apparatus in the direction of the chassis transverse axis, firstly brings about a behavior which harmonizes with a gear, a coupling and the first coupling rod, and secondly promotes a vibration-absorbing transverse elasticity of the first drive unit. As a result, firstly a reliable, comfortable and low-wear running behavior of the chassis is achieved, and secondly merely moderate mechanical loading of the chassis and the wagon body is brought about.

A particularly pronounced spread of the stiffnesses of the first bearing apparatus and the second bearing apparatus and therefore a great resistance against rotational and/or tilting movement of the first drive unit about the chassis longitudinal axis and about the chassis transverse axis and a smooth translational movability of the first drive unit in the direction of the chassis transverse axis are achieved if a stiffness ratio between the first stiffness and the second stiffness is set at at least 1 to 40.

Furthermore, it can be helpful if the first coupling rod is connected via the second bearing apparatus in an articulated manner to the at least first drive unit, the first coupling rod being connected to the second bearing apparatus via a joint which is arranged closer to the second crossmember than to the first crossmember.

By way of this measure, firstly relative movements between the chassis and the wagon body are compensated for effectively, and secondly angles of attack of the first coupling rod remain moderate even in the case of pronounced swivel and tilting movements, and/or the first coupling rod is sufficiently long even for pronounced swivel and tilting movements. Furthermore, the first coupling rod can be configured with a simple geometry, because routing of the first coupling rod as far as the first crossmember is avoided.

A favorable embodiment is achieved if the first bearing apparatus is arranged so as to protrude into at least one carrier cutout of the first crossmember. This measure achieves a certain amount of protection of the first bearing apparatus against environmental influences, and a space-saving arrangement.

Furthermore, it is helpful if at least a first spring apparatus of the first bearing apparatus is connected to the first crossmember, where the first spring longitudinal axis of the first spring apparatus is oriented parallel to a chassis vertical axis. This measure contributes to a stiff characteristic of the drive mounting in the direction of the chassis vertical axis and to a soft characteristic in the direction of the chassis transverse axis.

One advantageous embodiment is obtained, furthermore, if a second spring apparatus of the second bearing apparatus, the second spring longitudinal axis of which second spring apparatus is oriented parallel to a chassis longitudinal axis, a third spring apparatus of the second bearing apparatus, the third spring longitudinal axis of which third spring apparatus is oriented parallel to a chassis vertical axis, and a fourth spring apparatus of the second bearing apparatus, the fourth spring longitudinal axis of which fourth spring apparatus is oriented parallel to the chassis vertical axis, are connected to the second crossmember. As a result simple and/or standardized machine elements can be used for a realization of the drive mounting and its specific stiffness behavior, such as rubber/metal elements or helical springs, for the second spring apparatus, the third spring apparatus and the fourth spring apparatus.

It is favorable, moreover, if the second bearing apparatus has a spring cutout, the second spring apparatus being arranged so as to protrude into the spring cutout.

Firstly, a reduction in the mass of the second bearing apparatus is brought about on account of the spring cutout, and secondly the spring cutout acts as a mounting opening for the second spring apparatus, as a result of which a mounting and dismantling simplification of the second spring apparatus is achieved.

An advantageous embodiment is achieved if the second bearing apparatus has a leadthrough cutout, through which a wheelset shaft of the at least first wheelset is guided, where the leadthrough cutout is closed toward the bottom via a closure piece that is connected releasably to the second bearing apparatus. A lightweight construction principle in relation to the second bearing apparatus is also implemented via this measure. At the same time, it is possible on account of the closure piece to mount and to dismantle the first wheelset in the case of a mounted second bearing apparatus.

It can also be helpful if the second drive unit is connected via a third bearing apparatus to the first crossmember, where the first bearing apparatus and the third bearing apparatus are arranged so as to protrude into one another in a fork-like manner or forked manner. With this measure, the first bearing apparatus and the third bearing apparatus are connected in a space-saving manner to the first crossmember, and installation space that is available on the first crossmember is utilized efficiently.

An adaptive suspension behavior of the longitudinal follower is made possible if a coupling spring apparatus is connected to the first coupling rod, via which coupling spring apparatus the first coupling rod can be coupled to the wagon body, where the coupling spring apparatus has at least a first spring stiffness and a second spring stiffness that are configured differently from one another.

The first spring stiffness can be dimensioned, for example, with regard to high pulling forces of the rail vehicle, and the second spring stiffness can be dimensioned with regard to low pulling forces and low swivel and compression and rebound resistances. As a result, spring forces that are each appropriate are provided for different pulling force ranges.

Furthermore, it is advantageous if a second coupling rod is connected in an articulated manner to the second drive unit and is configured such that it can be coupled in a sprung manner to the wagon body of the rail vehicle. With this measure, loads are distributed to the first coupling rod and the second coupling rod. Depending on the traveling or pulling direction of the rail vehicle, either the first coupling rod or the second coupling rod is subjected to a tensile load. Compressive loads of the first coupling rod and the second coupling rod are avoided. The first coupling rod and the second coupling rod can be dimensioned as pure draw rods, that is to say they do not have to be formed as draw/buffer rods.

Coupling of the first drive unit and the second drive unit to one another is achieved if a pendulum that is arranged horizontally is provided between the at least first drive unit and the second drive unit. With this measure, a distribution of reaction forces from the first drive unit and the second drive unit is brought about to the drive mountings of the first drive unit and the second drive unit. The drive mountings and the longitudinal followers are partially relieved. In the case of reaction forces in the direction of the chassis longitudinal axis, mutual cancelation of the reaction forces is achieved in part.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the following text, the invention will be explained in greater detail on the basis of exemplary embodiments, in which.

DETAILED DESCRIPTION OF THE EXEMPLARY EMBODIMENTS

Figure 1:
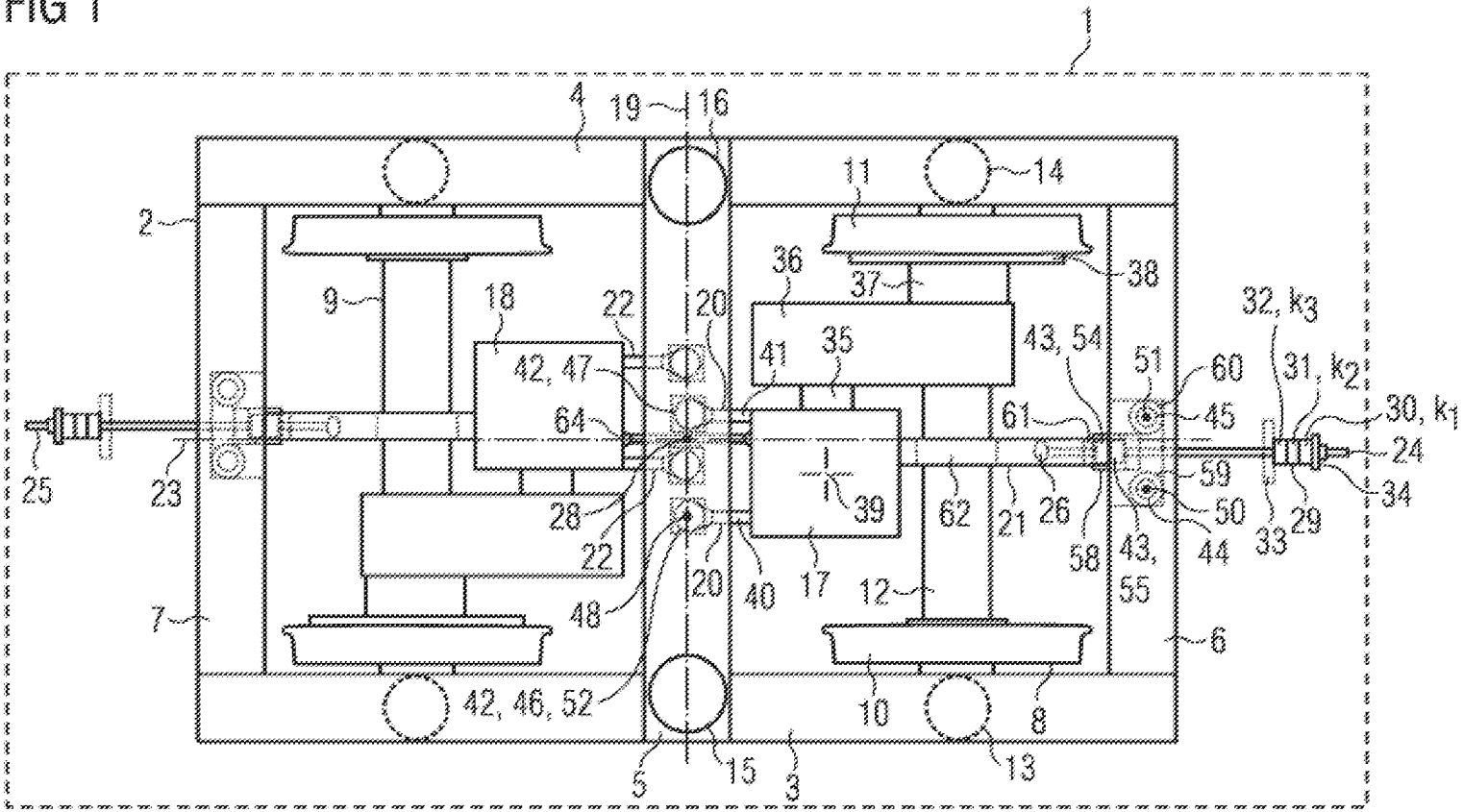
FIG. 1 shows an outline of an exemplary embodiment of a chassis of a rail vehicle with two drive units that are mounted in a sprung manner on a chassis frame via crossmembers of the chassis frame and are coupled via coupling rods to a wagon body of the rail vehicle in accordance with the invention.

FIG. 1 shows a chassis and a wagon body 1 of a rail vehicle in an outline illustration. The chassis has a chassis frame 2 that comprises a first longitudinal beam 3, a second longitudinal beam 4, a first crossmember 5, a second crossmember 6 and a third crossmember 7. The first crossmember 5 is configured as a central cross-connector of the chassis, and the second crossmember 6 and the third crossmember 7 are configured as end carriages of the chassis.

A first wheelset 8 and a second wheelset 9 are coupled to the chassis frame 2. The first wheelset 8 has a first wheel 10, a second wheel 11 and a wheelset shaft 12. The first wheelset 8 is connected via a first wheelset bearing, a first wheelset bearing housing, a first wheelset guide apparatus (which are not visible in FIG. 1), and via a first primary spring 13 to the first longitudinal beam 3 and via a second wheelset bearing, a second wheelset bearing housing, a second wheelset guide apparatus (which are not visible in FIG. 1) and via a second primary spring 14 to the second longitudinal beam 4. The second wheelset 9 is of identical configuration as the first wheelset 8 with regard to its construction and to its connecting technique to the chassis frame 2.

The wagon body 1 is arranged above the chassis. A first secondary spring 15 and a second secondary spring 16 are provided between the first crossmember 5 and an underside of the wagon body 1.

A first drive unit 17 and a second drive unit 18 are mounted in the chassis in a transversely elastic manner, i.e., in a vibration-absorbing manner with regard to movements in the direction of a chassis transverse axis 19. The first drive unit 17 is connected via a first bearing apparatus 20 to the first crossmember 5 and via a second bearing apparatus 21 to the second crossmember 6. The second drive unit 18 is coupled via further bearing apparatuses to the first crossmember 5 and to the third crossmember 7.

The first bearing apparatus 20, the second bearing apparatus 21 and the two further bearing apparatuses are oriented parallel to a chassis longitudinal axis 23.

A first coupling rod 24 is arranged between the first drive unit 17 and the underside of the wagon body 1, and a second coupling rod 25 is arranged between the second drive unit 18 and the underside of the wagon body 1.

The first coupling rod 24 is connected via the second bearing apparatus 21 in an articulated manner to the first drive unit 17, a joint 26 being provided between the first coupling rod 24. The joint 26 is arranged closer to the second crossmember 6 than to the first crossmember 5. The joint 26 has a joint axis 27 (shown in FIG. 2) that is oriented in a manner that is twisted out of a parallel to a chassis vertical axis 28 (appearing in a projecting manner in FIG. 1) by a parallel to the chassis transverse axis 19. The first coupling rod 24 can be moved rotationally about this joint axis 27.

A coupling spring apparatus 29 is connected to the first coupling rod 24, via which coupling spring apparatus 29 the first coupling rod 24 is coupled to the wagon body 1. The coupling spring apparatus 29 has a first coupling spring element 30 with a first spring stiffness $k_1$, a second coupling spring element 31 with a second spring stiffness $k_2$, and a third coupling spring element 32 with a third spring stiffness $k_3$, the first spring stiffness $k_1$, the second spring stiffness $k_2$ and the third spring stiffness $k_3$ being configured differently from one another.

The first coupling spring element 30 and the second coupling spring element 31 are configured as rubber/metal multilayered springs, and the third coupling spring element 32 is configured as a metallic helical spring. The third coupling spring element 32 is connected to a welded bracket 33 of the wagon body 1, as a result of which the first coupling rod 24 is coupled to the wagon body 1. The coupling spring apparatus 29 is clamped in under a prestress between a spring support 34 of the first coupling rod 24 and the welded bracket 33.

The first spring stiffness $k_1$ is greater than the second spring stiffness $k_2$, and the second spring stiffness $k_2$ is greater than the third spring stiffness $k_3$.

The first spring stiffness $k_1$ is 37 kN/mm, and the first coupling spring element 30 makes a maximum spring travel of 12 mm possible. The second spring stiffness $k_2$ has a magnitude of 6 kN/mm, and the second coupling spring element 31 permits a maximum deflection of 7 mm. The third spring stiffness $k_3$ is 0.2 kN/mm. The third coupling spring element 32 is prestressed by 25 mm and can be deflected by at most 3 mm.

In the case of a longitudinal force transmission or pulling force transmission (force transmission in the direction of the chassis longitudinal axis 23) between the wagon body 1 and the chassis, first of all the softest, third coupling spring element 32 comes into engagement as first spring stage in the case of low pulling forces. On account of its prestress, the coupling spring apparatus 29 cannot be released in the case of relative movements between the wagon body 1 and the chassis in the direction of the chassis longitudinal axis 23, that is to say it remains clamped in between the spring support 34 and the welded bracket 33.

On account of the low third spring stiffness $k_3$, the welded bracket 33 and the chassis frame 2 are loaded only weakly in the case of an engagement of the third coupling spring element 32.

If a first stop (not shown in FIG. 1) of the third coupling spring element 32 comes into engagement, the third coupling spring element 32 locks and the second coupling spring element 31 assumes a suspension function as harder, second spring stage. In this way, a transmission of pulling forces of medium magnitude occurs between the wagon body 1 and the chassis. The second coupling spring element 31 is configured to be soft enough such that swivel movements of the chassis when traveling around curves and compression and rebound operations of the chassis are not influenced and a largely jolt-free start is made possible.

If a second stop (not shown in FIG. 1) of the second coupling spring element 31 comes into engagement during a suspension operation of the second coupling spring element 31, then the second coupling spring element 31 locks and the first coupling spring element 30 assumes a suspension function as hard, third spring stage. Via the first coupling spring element 30 or the third spring stage, high to maximum pulling forces are transmitted between the wagon body 1 and the chassis.

The second coupling rod 25 is of identical configuration to the first coupling rod 24 with regard to its structural and connecting properties.

Depending on the direction of the pulling forces, either the first coupling rod 24 or the second coupling rod 25 is subjected to a tensile load. Compressive loads on the first coupling rod 24 and the second coupling rod 25 are avoided, for which reason the first coupling rod 24 and the second coupling rod 25 are configured as pull rods.

Furthermore, the first drive unit 17 is connected to the first wheel set 8 via a coupling 35, which is configured as a curved tooth coupling, and a gear 36 such that it can be displaced in the direction of the chassis transverse axis 19. The coupling 35 is provided between a drive shaft (not visible in FIG. 1) of the first drive unit 17 and a gear shaft (likewise not visible in FIG. 1) of the gear 36. The gear shaft is in turn connected to the wheelset shaft 12.

Relative movements between the drive shaft and the gear shaft in the direction of the chassis transverse axis 19 are compensated for in the coupling 35, and relative movements in the direction of the chassis longitudinal axis 23 are compensated for via a tilting capability of the gear shaft.

A protective tube 37 is provided, in an extension of the gear housing, between the gear 36 and the second wheel 11, where the protective tube 37 has a flange-like widened section 38 toward the second wheel 11. A spacing (not shown in FIG. 1 for reasons of simplification) is provided between the widened section 38 and the second wheel 11, in order for it to be possible, for example, for a wheel brake disk to be connected to the second wheel 11.

The first drive unit 17 is connected to the first crossmember 5 via the first bearing apparatus 20 such that it is sprung and can be moved in the direction of the chassis transverse axis 19, and is connected to the second crossmember 6 via the second bearing apparatus 21 such that it is sprung and can be moved in the direction of the chassis transverse axis 19.

The first drive unit 17 is mounted such that it can be moved rotationally to a limited extent about a drive vertical axis 39 which can be displaced in the direction of the chassis transverse axis 19.

Figure 3:
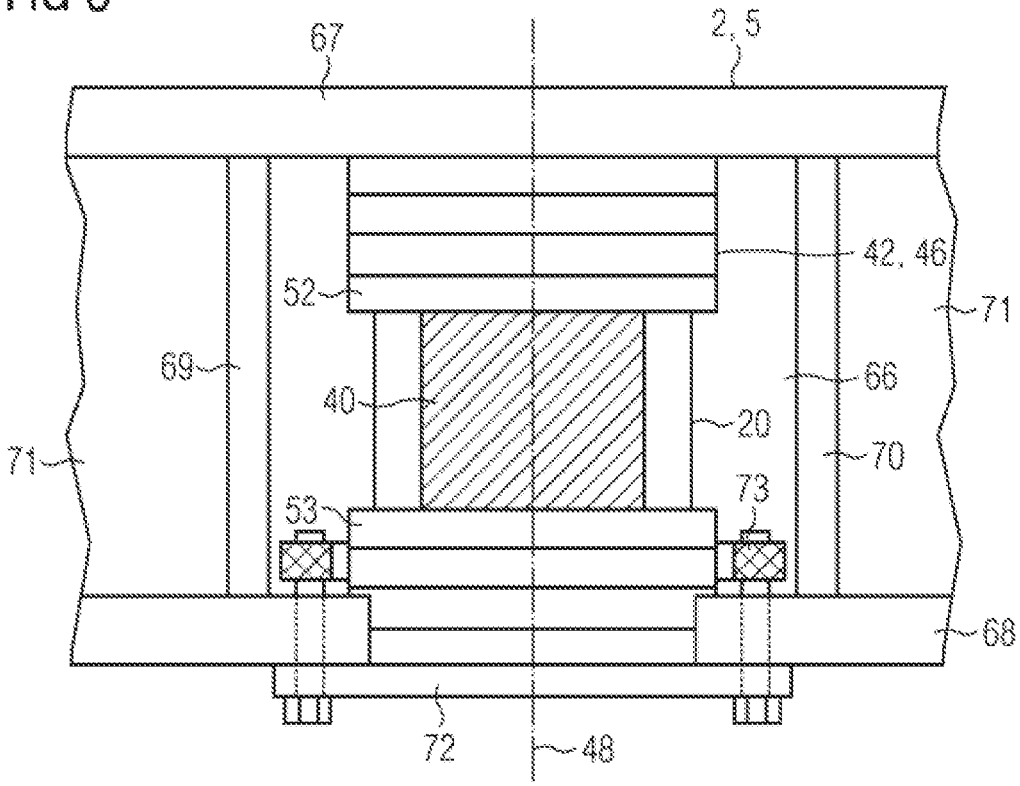
FIG. 3 shows a side view of a detail from a crossmember of the chassis frame of the exemplary embodiment of the chassis in accordance with the invention, where the crossmember includes a member cutout, into which a bearing apparatus of the drive unit of the chassis protrudes.

The first bearing apparatus 20 has a first bearing carrier 40 and a second bearing carrier 41 which are screwed to the first drive unit 17 in a manner that is spaced apart from one another. The first bearing carrier 40 and the second bearing carrier 41 are arranged so as to protrude into carrier cutouts of the first crossmember 5, where a carrier cutout 66 is shown in FIG. 3. The first bearing apparatus 20 has a first spring apparatus 42 which, in turn, comprises a first spring arrangement 46 and a second spring arrangement 47. The first spring arrangement 46 is provided between the first crossmember 5 and the first bearing carrier 40, and the second spring arrangement 47 is provided between the first crossmember 5 and the second bearing carrier 41.

A first spring longitudinal axis 48 (appearing in FIG. 1 in a projecting manner) of the first spring arrangement 46 is oriented parallel to the chassis vertical axis 28.

The first spring arrangement 46 comprises a first multilayered spring 52 and a second multilayered spring 53 (visible in FIG. 3).

The second spring arrangement 47 corresponds to the first spring arrangement 46 with regard to its structural properties and its orientation.

The first spring arrangement 46 and the second spring arrangement 47 are arranged within the carrier cutouts of the first crossmember 5.

The second bearing apparatus 21 is configured as a lightweight carrier and is screwed to the first drive unit 17.

A second spring apparatus 43, the second spring longitudinal axis 49 (shown in FIG. 2) of which is oriented parallel to the chassis longitudinal axis 23, a third spring apparatus 44, the third spring longitudinal axis 50 (appearing in FIG. 1 in a projecting manner) of which is oriented parallel to the chassis vertical axis 28, and a fourth spring apparatus 45, the fourth spring longitudinal axis 51 (appearing in FIG. 1 in a projecting manner) of which is oriented parallel to the chassis vertical axis 28, are connected to the second crossmember 6.

The second spring apparatus 43, the third spring apparatus 44 and the fourth spring apparatus 45 are parts of the second bearing apparatus 21. The second spring apparatus 43 is arranged centrally between the third spring apparatus 44 and the fourth spring apparatus 45 and offset in the direction of the chassis longitudinal axis 23 relative to the third spring apparatus 44 and to the fourth spring apparatus 45.

The second spring apparatus 43 is provided in and connected to a first spring pot 58, the third spring apparatus 44 is provided in and connected to a second spring pot 59, and the fourth spring apparatus 45 is provided in and connected to a third spring pot 60. The first spring pot 58, the second spring pot 59 and the third spring pot 60 are screwed to the second crossmember 6.

The second spring apparatus 43 comprises a third multilayered spring 54 and a fourth multilayered spring 55 that are separated from one another via a planar, grip-shaped section of the second bearing apparatus 21. The third multilayered spring 54 is connected to the first spring pot 58, and the fourth multilayered spring 55 is connected to the second crossmember 6. The planar, grip-shaped section of the second bearing apparatus 21 is arranged between the third multilayered spring 54 and the fourth multilayered spring 55.

The third spring apparatus 44 and the fourth spring apparatus 45 are of identical configuration to the second spring apparatus 43 with regard to the structural properties, but are oriented in a manner that is turned by 90° relative to the second spring apparatus 43.

The second spring apparatus 43 is provided in the region of a spring cutout 61 of the second bearing apparatus 21, where the second spring apparatus 43 is arranged so as to protrude into the spring cutout 61. The planar, grip-shaped section of the second bearing apparatus 21 is provided in the region of the spring cutout 61, with which planar, grip-shaped section the third multilayered spring 54 and the fourth multilayered spring 55 make contact. The third multilayered spring 54 is provided within the spring cutout 61, and the fourth multilayered spring 55 is provided outside the spring cutout 61.

A first overall stiffness of the first bearing apparatus 20 and the second bearing apparatus 21 in a plane that is formed by the chassis longitudinal axis 23 and the chassis vertical axis 28 and the second overall stiffness of the first bearing apparatus 20 and the second bearing apparatus 21 in the direction of the chassis transverse axis 19 can be set precisely and independently of one another on account of the first spring apparatus 42, the second spring apparatus 43, the third spring apparatus 44 and the fourth spring apparatus 45.

The first overall stiffness of the first bearing apparatus 20 and the second bearing apparatus 21 is greater than the second overall stiffness of the first bearing apparatus 20 and the second bearing apparatus 21.

A stiffness ratio between the first overall stiffness and the second overall stiffness of approximately from 1 to 50 is set.

Rotational movements of the first drive unit 17 about first parallels of the chassis longitudinal axis 23 and about second parallels of the chassis transverse axis 19 are substantially ruled out (prevented) via corresponding configuration and arrangement of the first bearing apparatus 20 and the second bearing apparatus 21.

The second bearing apparatus 21 has a leadthrough cutout 62, through which the wheelset shaft 12 of the first wheelset 8 is guided. The leadthrough cutout 62 is closed toward the bottom by means of a closure piece 63 (visible in FIG. 2) that is connected releasably to the second bearing apparatus 21.

The second drive unit 18 is of identical configuration to the first drive unit 17 and its connection to the first crossmember 5, the second crossmember 6 and the first wheelset 8 with regard to its connecting technique to the first crossmember 5, the third crossmember 7 and the second wheelset 9.

The second drive unit 18 is connected to the first crossmember 5 via a third bearing apparatus 22 which, like the first bearing apparatus 20, comprises two bearing carriers, to which spring arrangements are connected.

The first bearing carrier 40 with the first spring arrangement 46 and the second bearing carrier 41 with the second spring arrangement 47 of the first bearing apparatus 20 firstly and the bearing carriers and the spring arrangements of the third bearing apparatus 22 secondly are arranged so as to protrude into one another in a fork-like or forked manner.

A pendulum 64 that is arranged horizontally is provided between the first drive unit 17 and the second drive unit 18, which pendulum 64 is coupled in an articulated manner firstly to the first drive unit 17 and secondly to the second drive unit 18.

Figure 2:
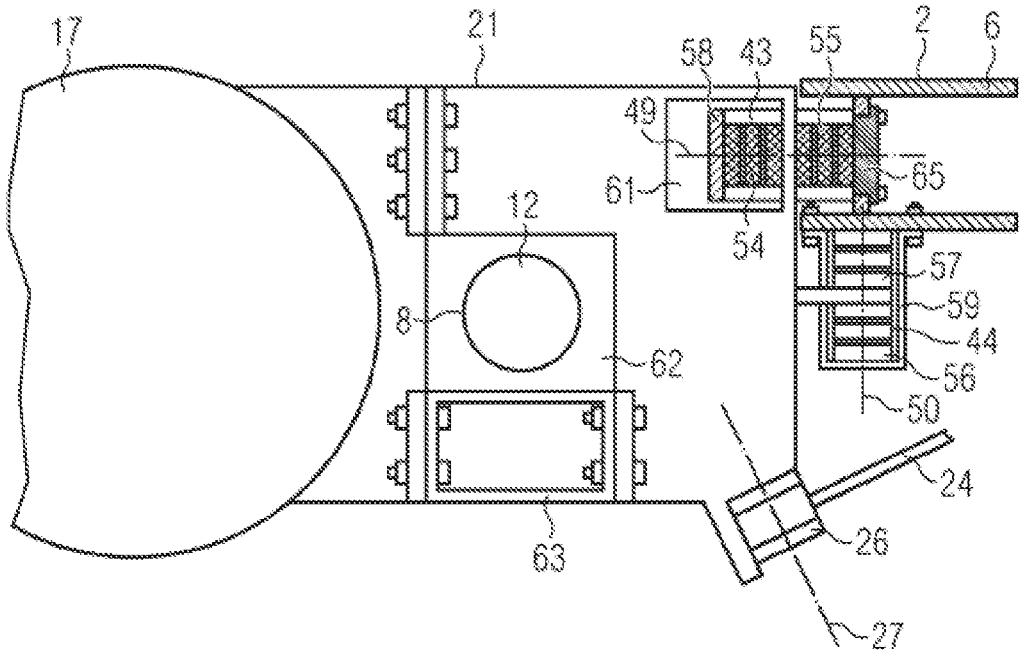
FIG. 2 shows a side view of a detail from the exemplary embodiment of the chassis in accordance with the invention, in which a bearing apparatus between a drive unit and a crossmember is shown.

FIG. 2 shows a side view of a detail of that exemplary embodiment of a chassis in accordance with the invention of a rail vehicle that is also shown in FIG. 1.

A first drive unit 17 of the chassis is connected via a first bearing apparatus 20 to a first spring apparatus 42 comprising a first spring arrangement 46 with a first multilayered spring 52 and a second multilayered spring 53, and a second spring arrangement 47 which is of identical configuration to the first spring arrangement 46, which spring arrangements are shown in FIG. 1 and in FIG. 3, to a first crossmember 5 (shown in FIG. 1 and in FIG. 3) of a chassis frame 2.

Furthermore, the first drive unit 17 is coupled via a second bearing apparatus 21, which comprises a second spring apparatus 43, a third spring apparatus 44 and a fourth spring apparatus (visible in FIG. 1), to a second crossmember 6, configured as an end carriage, of the chassis frame 2.

The second bearing apparatus 21 is configured as a steel lightweight carrier which is screwed to the first drive unit 17 and has a leadthrough cutout 62 and a spring cutout 61.

A wheelset shaft 12 of a first wheelset 8 of the chassis is guided through the leadthrough cutout 62.

The leadthrough cutout 62 is closed toward the bottom by means of a closure piece 63 which is screwed to the second bearing apparatus 21 and is therefore connected releasably. In the case of a dismantled closure piece 63, the first wheelset 8 can be threaded out of the leadthrough cutout 62 downward for dismantling and can be threaded upward into the leadthrough cutout 62 for mounting.

The second bearing apparatus 21 has a planar, grip-shaped section. A third multilayered spring 54 and a fourth multilayered spring 55 of the second spring apparatus 43, the second spring longitudinal axis 49 of which is oriented parallel to a chassis longitudinal axis 23 (shown in FIG. 1), make contact with the planar, grip-shaped section. The third multilayered spring 54 is connected to a first spring pot 58 (shown in sectioned form in FIG. 2), and the fourth multilayered spring 55 is connected laterally to a releasable insert 65 of the second crossmember 6.

The third multilayered spring 54 is arranged within the spring cutout 61. In a manner that engages around the second bearing apparatus 21 in the region of the spring cutout 61, the first spring pot 58 is screwed laterally to the second crossmember 6. The insert 65 that is likewise screwed laterally to the second crossmember 6 closes a mounting opening for the second spring apparatus 43. The fourth multilayered spring 55 is arranged between the insert 65 and the planar, grip-shaped section of the second bearing apparatus 21.

The third spring apparatus 44 has a third spring longitudinal axis 50 which is oriented parallel to a chassis vertical axis 28 (shown in FIG. 1). A fifth multilayered spring 56 and a sixth multilayered spring 57 are arranged in a second spring pot 59 that is screwed to an underside of the second crossmember 6. The fifth multilayered spring 56 is connected to the second spring pot 59 and a lug of the second bearing apparatus 21, and the sixth multilayered spring 57 is connected to the lug and the underside of the second crossmember 6. The lug of the second bearing apparatus 21 is arranged between the fifth multilayered spring 56 and the sixth multilayered spring 57.

The fourth spring apparatus 45 and a third spring pot 60 (shown in FIG. 1) are of identical configuration to the third spring apparatus 44 and the second spring part 59 with regard to their structural properties and their connecting techniques to the second crossmember 6.

A first coupling rod 24 (shown in details in FIG. 2) is connected via a joint 26 to the second bearing apparatus 21, which first coupling rod 24 is in turn coupled to a wagon body 1 (shown in FIG. 1) of the rail vehicle. The joint 26 is configured as a rotary joint and has a joint axis 27 that is oriented in a tilted manner with regard to the chassis vertical axis 28, parallel to a plane which is formed by the chassis longitudinal axis 23 and the chassis vertical axis 28. Accordingly, starting from the second bearing apparatus 21, the first coupling rod 24 runs upward to the wagon body 1, and is mounted on the second bearing apparatus 21 such that it can be rotated about the joint axis 27.

FIG. 3 discloses, as a side view, a detail of a first crossmember 5 of a chassis frame 2 which is part of an exemplary embodiment of a chassis (shown in FIG. 1) of a rail vehicle in accordance with the invention.

The first crossmember 5 has a carrier cutout 66 which is formed from a first strap 67 which is configured as an upper strap, a second strap 68 which is configured as a lower strap, and from a first side wall 69 and a second side wall 70 of the first crossmember 5. The first side wall 69 and the second side wall 70 are welded to the first strap 67, the second strap 68 and to a web 71 of the first crossmember 5. The web 71 has an interrupted configuration in the region of the carrier cutout 66.

A first bearing carrier 40, connected to a first drive unit 17 (shown in FIG. 1) of the chassis, of a first bearing apparatus 20 is arranged so as to protrude into the carrier cutout 66, and is connected via a lug of the first bearing carrier 40 to a first multilayered spring 52 and a second multilayered spring 53 of a first spring arrangement 46 of a first spring apparatus 42, the lug being arranged between the first multilayered spring 52 and the second multilayered spring 53.

The first multilayered spring 52 and the second multilayered spring 53 are configured as rubber/metal multilayered springs.

The first multilayered spring 52 is connected to the first strap 67, and the second multilayered spring 53 is connected to the second strap 68.

The first spring apparatus 42 is part of the first bearing apparatus 20 and has a first spring longitudinal axis 48.

In the region of the carrier cutout 66, the first crossmember 5 has a cylindrical opening which is closed via a cover 72.

The opening is provided in the second strap 68, extends in the vertical direction, and widens the carrier cutout 66 toward the bottom and toward the front.

The second multilayered spring 53 is arranged so as to protrude into the opening and so as to make contact with the cover 72. The cover 72 is screwed to the second strap 68.

An annular stop 73 made from rubber is provided in the carrier cutout 66, between the first crossmember 5 and a shell face of the second multilayered spring 53, where the annular stop 73 surrounds the second multilayered spring 53 and is connected to screws that are provided for the connection of the cover 72 to the second strap 68. As a result, lateral deflections of the first bearing carrier 40 are limited.

A second spring arrangement 47 (shown in FIG. 1), connected to a second bearing carrier 41 (likewise shown in FIG. 1) of the first bearing apparatus 20, of the first spring apparatus 42 is of identical configuration to the first spring arrangement 46 with regard to its structural properties and its connecting technique to the first crossmember 5.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A chassis of a rail vehicle, comprising:

at least one chassis frame;

at least a first wheelset and a second wheelset coupled to the at least one chassis frame;

at least a first drive unit and a second drive unit connected to the at least one chassis frame;

a first coupling rod connected in an articulated manner to the at least first drive unit and being rotatable about a joint axis arranged transversely with respect to a horizontal plane, the first coupling rod being configured to be coupled in a sprung manner to a wagon body of the rail vehicle;

wherein the at least first drive unit is connected to the at least first wheelset via a coupling such that the at least first drive unit is displaceable in a direction of a chassis transverse axis, and the at least first drive unit is connected via a first bearing apparatus to a first crossmember of the at least one chassis frame in a sprung manner and such that the at least first drive unit is movable in the direction of the chassis transverse axis, and the at least first drive unit is connected via a second bearing apparatus to a second crossmember of the at least one chassis frame in a sprung manner and such that the at least first drive unit is movable in the direction of the chassis transverse axis, the at least first drive unit being mounted such that the at least first drive unit is rotationally movable about a drive vertical axis which is displaceable in the direction of the chassis transverse axis.

2. The chassis as claimed in claim 1, wherein first stiffnesses of the first bearing apparatus and the second bearing apparatus in a plane which is formed by a chassis longitudinal axis and a chassis vertical axis and second stiffnesses of the first bearing apparatus and the second bearing apparatus in the direction of the chassis transverse axis are settable independently of one another.

3. The chassis as claimed in claim 2, wherein the first stiffness of the first bearing apparatus and the second bearing apparatus in a plane which is formed by a chassis longitudinal axis and a chassis vertical axis is greater than a second stiffness of the first bearing apparatus and the second bearing apparatus in the direction of the chassis transverse axis.

4. The chassis as claimed in claim 1, wherein a first stiffness of the first bearing apparatus and the second bearing apparatus in a plane which is formed by a chassis longitudinal axis and a chassis vertical axis is greater than a second stiffness of the first bearing apparatus and the second bearing apparatus in the direction of the chassis transverse axis.

5. The chassis as claimed in claim 4, wherein a stiffness ratio between the first stiffness and the second stiffness is set at a value of at least 1 to 40.

6. The chassis as claimed in claim 1, wherein the first bearing apparatus and the second bearing apparatus are configured so as to substantially prevent rotational movements of the at least first drive unit about first parallels of the chassis longitudinal axis and about second parallels of the chassis transverse axis.

7. The chassis as claimed in claim 1, wherein the first coupling rod is connected via the second bearing apparatus in an articulated manner to the at least first drive unit, the first coupling rod being connected to the second bearing apparatus via a joint which is arranged closer to the second crossmember than to the first crossmember.

8. The chassis as claimed in claim 1, wherein the first bearing apparatus is arranged so as to protrude into at least one carrier cutout of the first crossmember.

9. The chassis as claimed in claim 1, wherein at least a first spring apparatus of the first bearing apparatus is connected to the first crossmember, a first spring longitudinal axis of said first spring apparatus being oriented parallel to a chassis vertical axis.

10. The chassis as claimed in claim 1, wherein a second spring apparatus of the second bearing apparatus, a second spring longitudinal axis of which second spring apparatus is oriented parallel to a chassis longitudinal axis, a third spring apparatus of the second bearing apparatus, a third spring longitudinal axis of which third spring apparatus is oriented parallel to a chassis vertical axis, and a fourth spring apparatus of the second bearing apparatus, a fourth spring longitudinal axis of which fourth spring apparatus is oriented parallel to the chassis vertical axis, are connected to the second crossmember.

11. The chassis as claimed in claim 10, wherein the second bearing apparatus includes a spring cutout, the second spring apparatus being arranged so as to protrude into the spring cutout.

12. The chassis as claimed in claim 11, wherein the second bearing apparatus has a leadthrough cutout, a wheelset shaft of the at least first wheelset being guided through leadthrough cutout which is closed toward a bottom end via a closure piece which is releasably connected to the second bearing apparatus.

13. The chassis as claimed in claim 1, wherein the second drive unit is connected via a third bearing apparatus to the first crossmember, the first bearing apparatus and the third bearing apparatus being arranged so as to protrude into one another in a forked manner.

14. The chassis as claimed in claim 1, further comprising:

a coupling spring apparatus connected to the first coupling rod which is couplable to the wagon body via the coupling spring apparatus which includes at least a first spring stiffness and a second spring stiffness which are configured differently from one another.

15. The chassis as claimed in claim 1, further comprising:

a second coupling rod connected in an articulated manner to the second drive unit, the second coupling rod being such to be coupled in a sprung manner to the wagon body of the rail vehicle.

16. The chassis as claimed in claim 1, further comprising:

a pendulum which is arranged horizontally and provided between the at least first drive unit and the second drive unit.

* * * * *